US006161514A

United States Patent [19]

Ernst et al.

[11] Patent Number: 6,161,514

[45] Date of Patent: Dec. 19, 2000

[54] AIR INTAKE MODULE FOR AN INTERNAL COMBUSTION ENGINE

[75] Inventors: Volker Ernst, Sachsenheim; Arthur Klotz, Remseck; Rudolf Leipelt, Marbach; Thomas Schermuly, Flein, all of Germany

[73] Assignee: Filterwerk Mann & Hummel GmbH, Ludwigshafen, Germany

[21] Appl. No.: 09/319,190

[22] PCT Filed: Nov. 8, 1997

[86] PCT No.: PCT/EP97/06213

§ 371 Date: Aug. 11, 1999

§ 102(e) Date: Aug. 11, 1999

[87] PCT Pub. No.: WO98/21468

PCT Pub. Date: May 22, 1998

[30] Foreign Application Priority Data

Nov. 14, 1996 [DE] Germany ..... 196 47 184

[51] Int. Cl.[7] ..... F02N 3/00

[52] U.S. Cl. ..... 123/188.47; 123/188.61

[58] Field of Search ..... 123/188.34, 188.42, 123/188.47, 188.61

[56] References Cited

U.S. PATENT DOCUMENTS 4,141,879 2/1979 McCarroll ..... 524/196

5,003,933 4/1991 Rush, II et al. ..... 123/184.42

FOREIGN PATENT DOCUMENTS 2457155 7/1975 Germany .

OTHER PUBLICATIONS

Modern Plastic International, Jun. 1993, No. 6 pp. 19, 20.

*Primary Examiner*—Noah P. Kamen

*Attorney, Agent, or Firm*—Evenson, McKeown, Edwards & Lenahan, P.L.L.C.

[57] ABSTRACT

A suction or air intake module for an internal combustion engine comprising an air suction pipe made of synthetic resin material and a flange joint at the air intake on the cylinder head housing of the internal combustion engine. The air suction pipe is a one-piece blown element of synthetic resin material and is disposed by a spring in a housing part of the air intake module with the air outlet end of the air suction pipe extending into the area of a connection between the housing part and the cylinder head housing. A flange is arranged in the connecting area between the housing part and the cylinder head housing, the flange forming a single piece with the housing part and enabling the housing part to be sealingly attached to the air inlet of the cylinder head housing.

7 Claims, 1 Drawing Sheet

AIR INTAKE MODULE FOR AN INTERNAL COMBUSTION ENGINE

The invention relates to a suction module for an internal combustion engine according to the preamble of the main claim.

STATE OF THE ART

It is known, for example, from the article "Plastic suction pipes —first experiences and experimental results", Axel Kamprach, from ATZ, Automobiltechnische Zeitschrift 87, 1985 (10), pages 519–528 to provide synthetic resin pipes as air suction pipes for supplying combustion air to motor vehicle motors. Here, making suction pipes of synthetic material is suggested, particularly to avoid the disadvantages of conventional aluminum die-cast parts, such as high production costs and the necessity of subsequently working rough surfaces.

The conventional production processes for shaping three-dimensional pipe structures made of synthetic resin material are, for example, a so-called core melting process or the prefabrication of half shells which after being joined together, are externally coated again with synthetic resin material.

In the core melting process, first a core (made, for example, of tin/bismuth alloy) for the pipe to be formed is cast which corresponds to the pipe's hollow interior. This core is externally coated with the synthetic resin material and subsequently melted out, so that the hollow pipe remains. This known process is disadvantageous since very high demands are made on the pressure-resistant core material, and the production process is very expensive and time-consuming. The other possible production process of prefabricating the half shells prefabrication of half shells, involves relatively high tool costs and is also disadvantageous because the required sealed connection of the two half shells necessitate additional flanges or further production steps.

STATEMENT OF OBJECT

It is the object of the invention to further develop a suction module for an internal combustion engine according to the preamble of the main claim in a simple way so that simple manufacture is possible and a well sealed suction device can be constructed therewith.

ADVANTAGES OF THE INVENTION

The suction module according to the invention solves the proposed object with the features listed in the characterizing portion of the main claim. This suction module according to the invention is advantageous in that by using a blown part of synthetic resin material for the air suction pipe, it is possible to employ a simple production process, even for more complex three-dimensional pipe structures. The required tightly sealed connection of the suction pipe to the cylinder head housing of the internal combustion engine is thereby assured in an advantageous manner in that the housing of the suction device is tightly sealed via a flange while the suction pipe is held in the housing and doesn't itself require any sealed connection to the cylinder head housing.

The assembly of the suction module is effected in a simple manner by an attachment of the suction pipe, for example by means of a leaf or clamp spring, in at least one of the half shells of the housing, by tightly joining together the half shells of the housing, and by subsequently assembling the flange of the housing of the suction module to the cylinder head housing of the internal combustion engine. Here, the housing of the suction module may advantageously be made of very temperature-resistant glass fiber-reinforced polyamide and the suction pipe may be produced as a blown tube made of polyamide.

The flexible attachment of the suction pipe makes possible in a simple manner the optimal selection of a suction pipe with respect to its geometrical form, and, in particular, the use of a suction pipe with an appropriately matched length, in a housing which remains substantially unchanged.

DRAWING

An exemplary embodiment of the suction module according to the invention is explained with reference to the drawing, which shows a cross-section through a suction pipe in a housing.

DESCRIPTION OF THE EXEMPLARY EMBODIMENT

Figure 1:
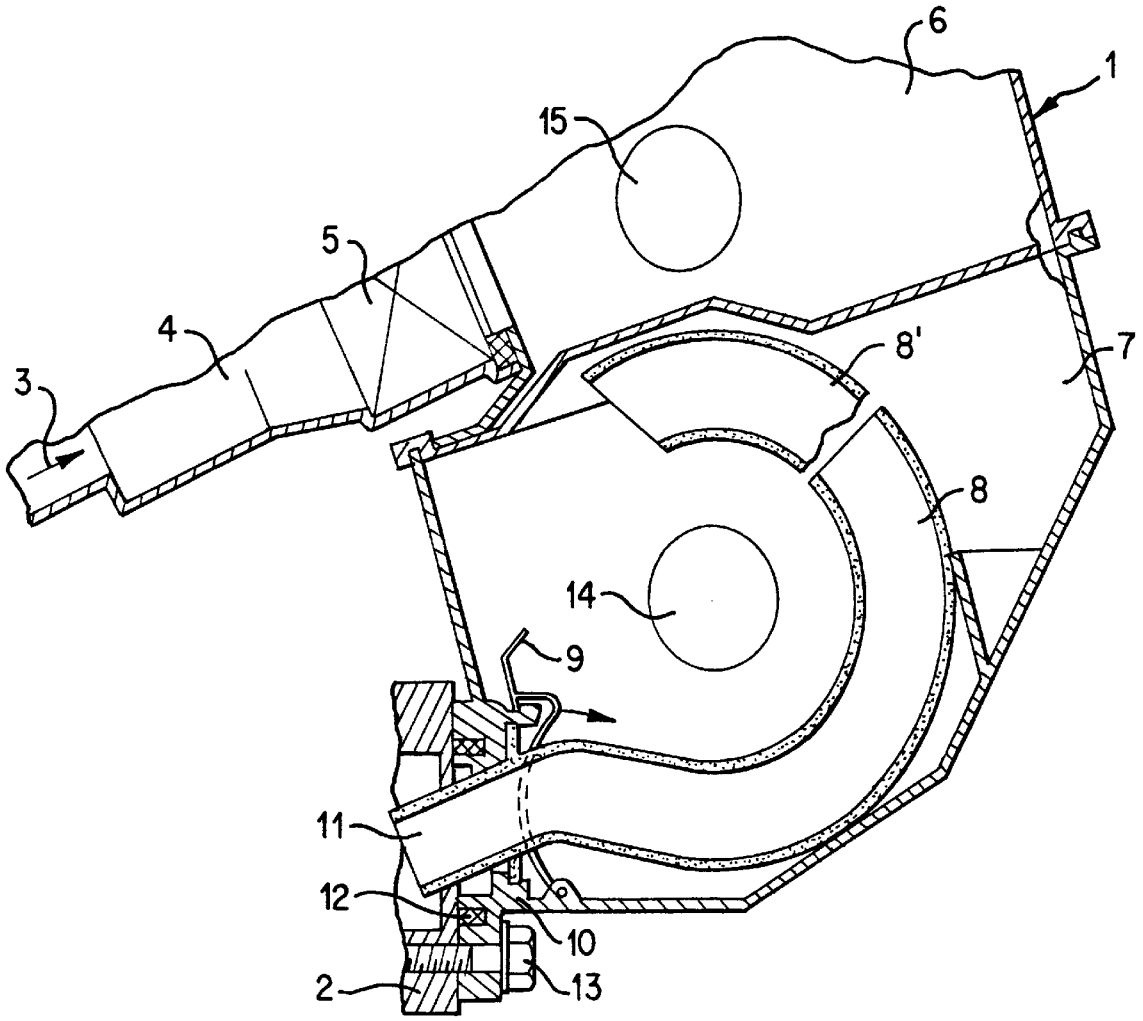

In the FIGURE, a cross-section is shown through a housing 1 of a suction module for an internal combustion engine of a motor vehicle, not shown here with the exception of a mounting surface on the cylinder head housing 2. An air stream is aspirated through the suction module in accordance with arrow 3 in the direction of the inlet openings in the cylinder head housing 2. The unfiltered air in inlet 4 of the suction module is channeled through an air filter 5 into the clean air chamber region 6 of the suction module.

In the lower housing part 7 of the housing 1, an air suction pipe 8 is inserted which is produced completely as a blown tube made of polyamide. The length of the suction pipe 8 thereby can also be adapted to the characteristics of the internal combustion engine and can also, for example, include an extension 8'. The air suction pipe 8 is held against the lower housing part 7, for example, by using a leaf or clamp spring 9. The air outlet region of the lower housing part 7 is constructed as a flange 10, which on the inside receives an end 11 of the air suction pipe 8 and on the outside is attachable to the cylinder head housing 2. To seal the lower housing part 7 to the cylinder head housing 2, a seal 12 is provided which is pressed against the cylinder head 2 by means of a clamping device 13.

The aspirated air can thus go from the clean air chamber region 6 through a filtered air outlet 15 to a throttle valve, not shown here, and then through a filtered air inlet 14 and into the air suction pipe 8, which in particular is spatially optimized with regard to sound emission, and then directly into the inlet on the cylinder head 2. A sealing attachment is only necessary here between the flange 10 of the housing part 7, which is made of very strong and temperature-resistant material, and the cylinder head housing 2, which among other things produces rather high temperatures; a sealing arrangement between the air suction pipe 8 made of polyamide and the cylinder head housing 2 is not required in this case. Neither is a seal between the air suction pipe 8 and the lower housing part 7 critical since any possible additional air would only be sucked in from the clean air chamber region 6.

What is claimed is:

1. An air intake module for an internal combustion engine having a cylinder head housing with an air inlet opening, said air intake module comprising:

a housing part having an air outlet and an integral connecting flange formed in one piece with said housing at said air outlet, said connecting flange being sealingly connectable to said cylinder head housing with said housing air outlet in communication with said cylinder head housing air inlet opening;

an air suction pipe arranged in said housing part with one end of said air suction pipe extending to said housing part air outlet, said air suction pipe being a one-piece blown tube of synthetic resin material; and a spring securing said air suction pipe in position in said housing part.

2. An air intake module according to claim 1, wherein said housing part comprises two half shells sealingly joined together with said one end of air suction pipe tightly enclosed between them at said housing part air outlet.

3. An air intake module according to claim 1, wherein said housing part is composed of polyamide material reinforced with glass fibers.

4. An air intake module according to claim 1, wherein said air suction pipe has a length matched to characteristics of the internal combustion engine to minimize noise emissions.

5. An air intake module according to claim 1, wherein said air suction pipe is composed of polyamide material.

6. An air intake module according to claim 1, wherein said air suction pipe is composed of polypropylene.

7. An air intake module according to claim 1, further comprising a seal arranged adjacent said housing part air outlet, said seal assuring an air tight connection between said housing part and said cylinder head housing air inlet opening when said housing part is connected to the cylinder head housing.

* * * * *